US010856683B2

(12) United States Patent
Wu

(10) Patent No.: US 10,856,683 B2
(45) Date of Patent: Dec. 8, 2020

(54) WOOD-MADE STRAW

(71) Applicant: Jui-Ping Wu, Zhubei (TW)

(72) Inventor: Jui-Ping Wu, Zhubei (TW)

( * ) Notice: Subject to any disclaimer, the term of this patent is extended or adjusted under 35 U.S.C. 154(b) by 58 days.

(21) Appl. No.: 16/180,339

(22) Filed: Nov. 5, 2018

(65) Prior Publication Data

US 2020/0138215 A1 May 7, 2020

(51) Int. Cl.
*A47G 21/18* (2006.01)

(52) U.S. Cl.
CPC ..... *A47G 21/18* (2013.01)

(58) Field of Classification Search
CPC ..... A47G 21/18
USPC ..... 239/33
See application file for complete search history.

(56) References Cited

U.S. PATENT DOCUMENTS 3,168,982 A * 2/1965 Davis ..... A47G 21/18 239/33
9,132,204 B2 * 9/2015 McKay ..... A01N 25/34

* cited by examiner

*Primary Examiner* — Christopher S Kim
(74) *Attorney, Agent, or Firm* — Rosenberg, Klein & Lee

(57) ABSTRACT

A wood-made straw includes a hollow tube formed by a wood sheet wound and an adhesive film wrapping the outer surface and the inner surface of the hollow tube. The adhesive film includes an edible glue made of natural material. The edible glue can improve the hardness of the hollow tube and have flexible, soft, and moistureproof properties. The wood sheet further includes two log sheets and a paper sheet therebetween to improve the whole strength and waterproof properties. The wood-made straw is made of natural material which is rapidly biodegradable. It costs 1-6 months to naturally decompose the wood-made straw. Thus, the wood-made straw has a vale for environment protection.

8 Claims, 6 Drawing Sheets

WOOD-MADE STRAW

BACKGROUND OF THE INVENTION

Field of the Invention

The present invention relates to a straw for drinking water, particularly to a wood-made straw that is rapidly biodegradable for environment protection.

Description of the Related Art

Straws are hollow tubes that are mostly used to sucking liquids. For example, straws are used as dining utensils for drinking beverages, such that drinking beverages is more polite and convenient. Besides, the probability of buying beverages is higher in summer. Taking consideration of the convenience and hygiene, shopkeepers and consumers almost use disposable plastic straws as tools for drinking beverages.

However, plastic straws are made of high molecular weight synthetic resin that cannot be biodegradable. After the use of plastic straws, dirt which remains on the plastic straws is difficultly cleaned. Thus, the dirty plastic straws are difficultly recycled and the cost of handling plastic straws is higher. Although plastic straws and the burnable trash are sent to the incinerator and incinerated, handling the incineration residue and fumes exhausted during refuse incineration is a problem to be presently faced.

In order to overcome the problem with disposable straws polluting environment, two kinds of straws, such as reusable straws and disposable straws for environment protection, are gradually developed now. Reusable straws are made of bamboo, stainless steel, or glass. Nevertheless, the cost of fabricating straws made of stainless steel or glass is high. In addition, the hollow portion of the straw is narrow, and thus a cleaning device is hard to put into the hollow portion. Over time, bacteria are easily bred to influence health.

Disposable straws for environment protection are made of paper or bagasse-granulated material. However, the paper straw is 10 times of the cost of the plastic straw and softens due to sodas. Thus, the paper straw has low endurance. Although the bagasse-granulated straw has the low cost and biodegradable properties, the bagasse-granulated straw comprises polylactic acid (PLA). As a result, the bagasse-granulated straw is decomposed using a special process and more resources. Thus, the environmental value of the bagasse-granulated straw is still being assessed.

To overcome the abovementioned problems, the present invention provides a wood-made straw, so as to solve the afore-mentioned problems of the prior art.

SUMMARY OF THE INVENTION

The primary objective of the present invention is to provide a wood-made straw made of natural material which is rapidly biodegradable and has a value for environment protection.

Another objective of the present invention is to provide a wood-made straw, which uses its adhesive film to have flexible, soft, and moistureproof properties.

Further objective of the present invention is to provide a wood-made straw, which has the fabrication cost, the simple structure, conveniently-processed and rapidly-processed properties, and the high production efficiency.

To achieve the abovementioned objectives, the present invention provides a wood-made straw, which comprises a hollow tube formed by a wood sheet wound; and an adhesive film wrapping the outer surface and the inner surface of the hollow tube. The adhesive film may comprise an edible glue.

In an embodiment of the present invention, the wood sheet further comprises two log sheets and a paper sheet therebetween. The log sheets are basswood sheets, birch sheets, maple sheets, cedarwood sheets, ash sheets, rubber wood sheets, *paulownia* log sheets, beech sheets, cypress sheets, poplar sheets, *cunninghamia lanceolata* sheets, camphorwood sheets, or pine sheets. The paper sheet may be glassine paper, simili paper, or laminating paper.

Below, the embodiments are described in detail in cooperation with the drawings to make easily understood the technical contents, characteristics and accomplishments of the present invention.

DETAILED DESCRIPTION OF THE INVENTION

The present invention provides a disposable straw made of natural material that can withstand temperatures of from −30° C. to 100° C. In any environment, it costs 1-6 months to naturally decompose the wood-made straw after the use of the wood-made straw. Besides, the wood-made straw is used as organic fertilizer and has a value for environment protection.

Figure 1:
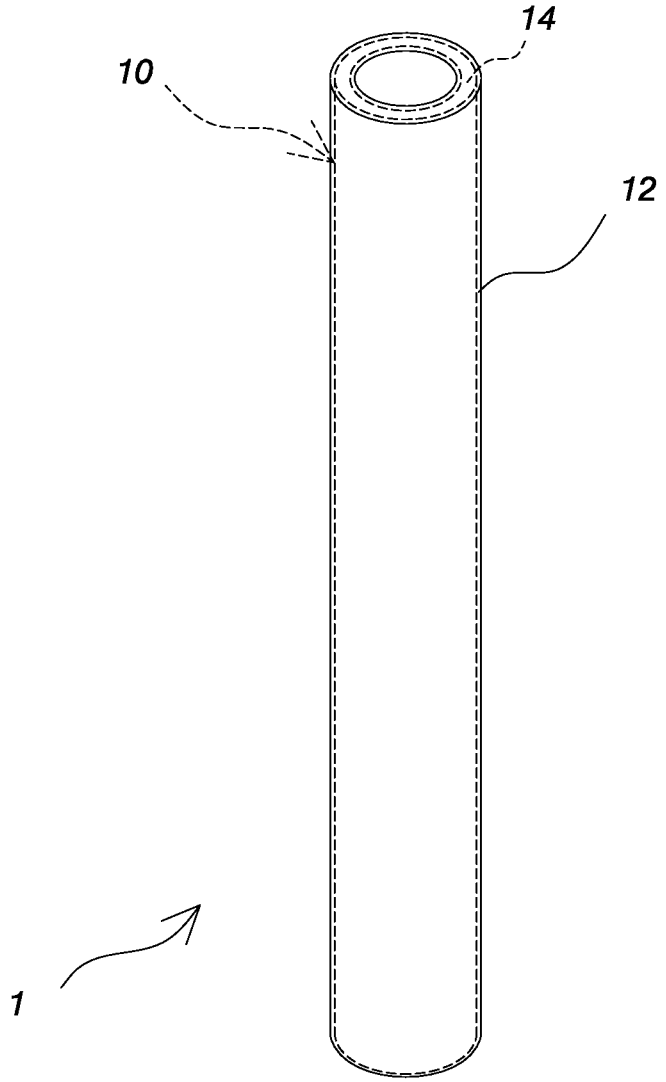
FIG. 1 is a perspective view of a wood-made straw according to the first embodiment of the present invention.
Figure 2:
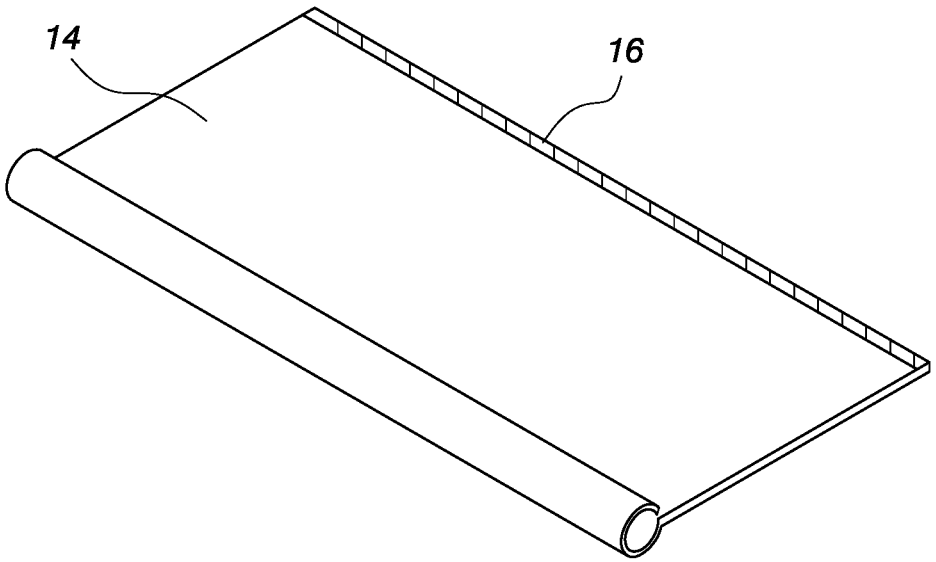
FIG. 2 is a diagram schematically showing a wound wood sheet according to the first embodiment of the present invention.

Refer to FIG. 1 and FIG. 2. The first embodiment of the wood-made straw is introduced as follows. The wood-made straw 1 comprises a hollow tube 10 and an adhesive film 12. The adhesive film 12 completely wraps the outer surface and the inner surface of the hollow tube 10. The adhesive film 12 comprises an all-natural edible glue. The adhesive film 12 can penetrate into the pores on the surface of the hollow tube 10 and completely wrap the hollow tube 10, thereby improving the flexibility and softness of the hollow tube 10 and achieving the waterproof and moistureproof purposes.

The hollow tube 10 is wound by a wood sheet 14. The wood sheet 14 is provided with a second glue 16. The second glue 16 is an adhesive edible glue made of all-natural material. The wood sheet 14 uses the second glue 16 to stick to each other to form the hollow tube 10 after winding the wood sheet 14. The wood sheet 14 is formed by whittling wood. The wood sheet 14 has a density of larger than 0.42 g/cm$^3$. The wood sheet 14 may be a basswood sheet, a birch sheet, a maple sheet, a cedarwood sheet, an ash sheet, a rubber wood sheet, a *paulownia* log sheet, a beech sheet, a cypress sheet, a poplar sheet, a *cunninghamia lanceolata* sheet, a camphorwood sheet, or a pine sheet. These wood sheets have the higher densities, hardness, and toughness to effectively improve the endurance of the wood-made straw 1.

Figure 3:
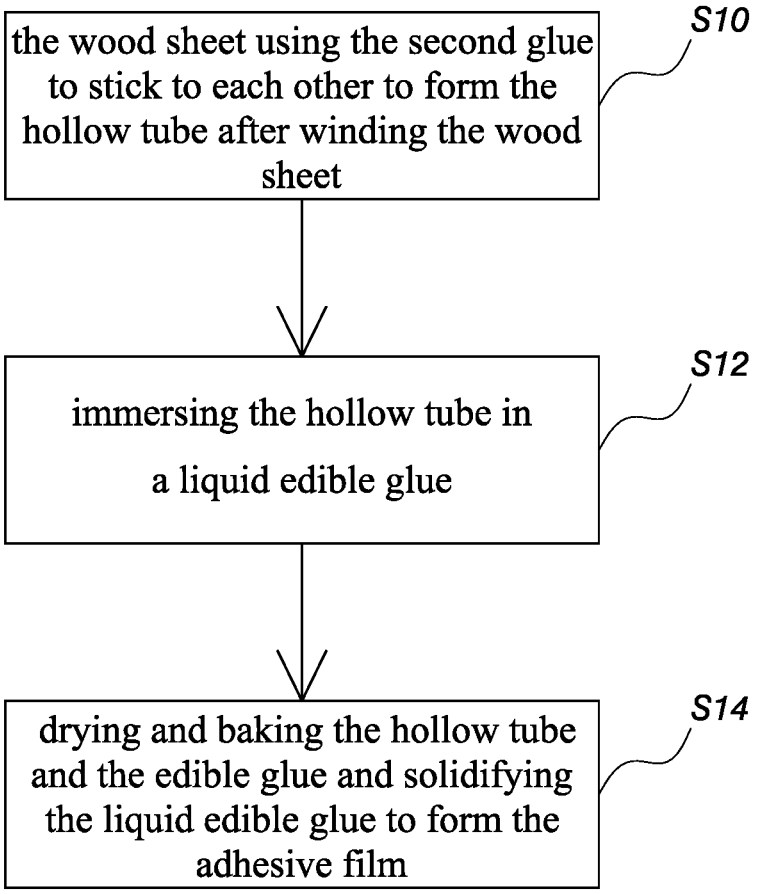
FIG. 3 is a flowchart of fabricating a wood-made straw according to the first embodiment of the present invention.
Figure 4:
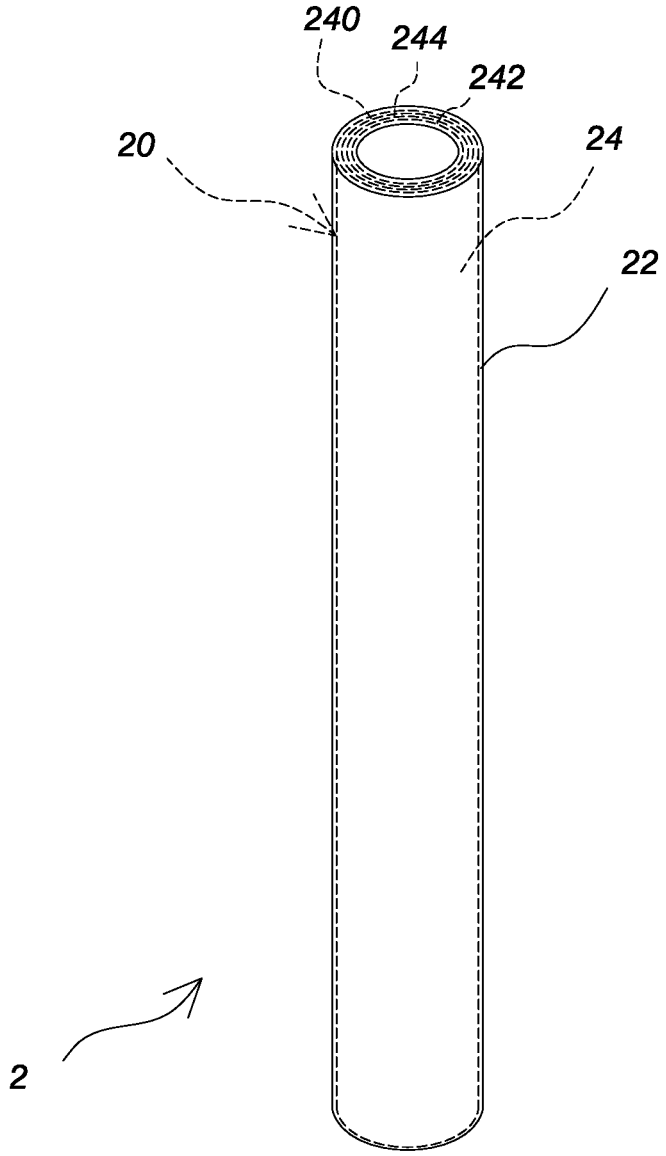
FIG. 4 is a perspective view of a wood-made straw according to the second embodiment of the present invention.

After describing the structure of the wood-made straw, the method for fabricating the wood-made straw is described as follows. Refer to FIGS. 1-3. In Step S10, the wood sheet 14 uses the second glue 16 to stick to each other to form the hollow tube 10 after winding the wood sheet 14. Then, the process proceeds to Step S12. In Step S12, the hollow tube 10 is placed in a container accommodating a liquid edible glue, such that the hollow tube 10 is immersed in the liquid edible glue for two hours. Thus, the edible glue effectively penetrates into the pores on the surface of the hollow tube 10, whereby the edible glue wraps the hollow tube 10.

Finally, the process proceeds to Step S14. In Step S14, the hollow tube 10 is taken from the container accommodating the liquid edible glue and dried for 10 minutes. Then, the hollow tube 10 and the edible glue thereon are baked by wind having a temperature of 75° C. for 15 minutes, such that the liquid edible glue is solidified to form the adhesive film 12 on the inner and outer surfaces of the hollow tube 10, thereby completing the wood-made straw 1.

In addition to the abovementioned embodiment, the present invention provides another embodiment of the wood-made straw. Refer to FIGS. 4-7. The wood-made straw 2 comprises a hollow tube 20 and an adhesive film 22 wrapping the inner surface and the outer surface of the hollow tube 20. The adhesive film 22 comprises an all-natural edible glue. The adhesive film 22 can penetrate into the pores on the surface of the hollow tube 20 and completely wrap the hollow tube 20, thereby improving the flexibility and softness of the hollow tube 20 and achieving the waterproof and moistureproof purposes.

Figure 5:
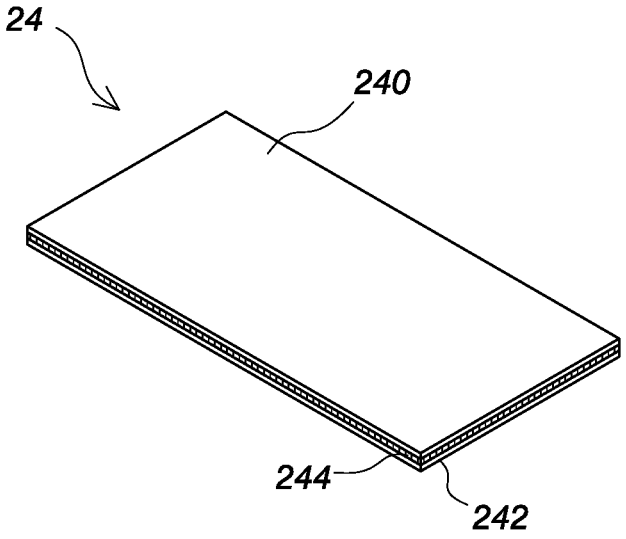
FIG. 5 is a perspective view of a wood sheet according to the second embodiment of the present invention.
Figure 6:
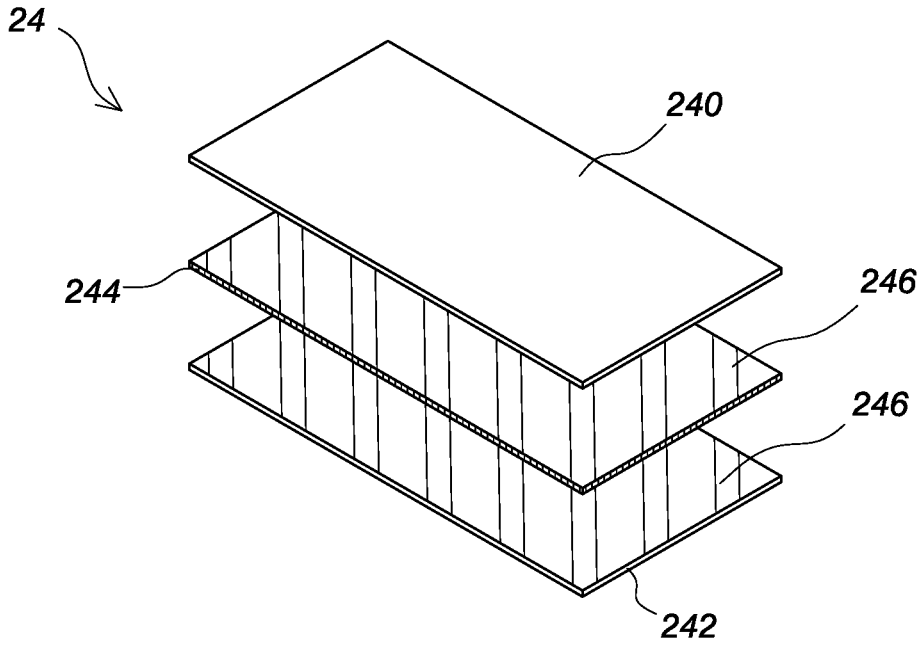
FIG. 6 is an exploded view of a wood sheet according to the second embodiment of the present invention.

Refer to FIG. 5 and FIG. 6. The wood sheet 24 of the embodiment is different from that of the first embodiment. The wood sheet 24 comprises two log sheets 240 and 242 and a paper sheet 244 therebetween, wherein a first glue 246 is formed between the paper sheet 244 and each of the log sheets 240 and 242. The first glue 246 is an all-natural edible glue with adhesion. The paper sheet 244 and each of the log sheets 240 and 242 use the first glues 246 stick to each other. The log sheets 240 and 242 are formed by whittling wood. Each of the log sheets 240 and 242 has a density of larger than 0.42 g/cm$^3$. The log sheets 240 and 242 may be basswood sheets, birch sheets, maple sheets, cedarwood sheets, ash sheets, rubber wood sheets, *paulownia* log sheets, beech sheets, cypress sheets, poplar sheets, *cunninghamia lanceolata* sheets, camphorwood sheets, or pine sheets. These wood sheets have the higher densities, hardness, and toughness to effectively improve the endurance of the wood-made straw 2. The paper sheet 244 may be high-density paper, such as glassine paper, simili paper, or laminating paper, thereby improving the moistureproof function and the hardness of the wood-made straw 2.

Figure 7:
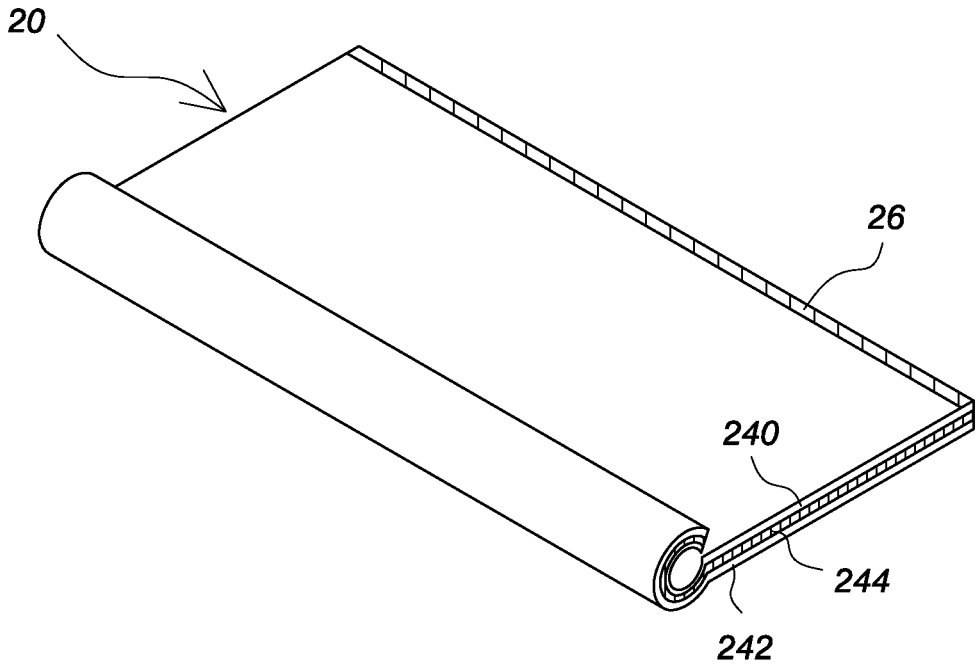
FIG. 7 is a diagram schematically showing a wound wood sheet according to the second embodiment of the present invention.

Refer to FIG. 7. After the log sheets 240 and 242 and the paper sheet 244 stick to each other to form the wood sheet 24, the wood sheet 24 is wound. Then, the wood sheet 24 uses a second glue 26 to stick and form the hollow tube 20, wherein the second glue 26 is an edible glue made of all-natural material. The edible glue is liquid and adhesive. Finally, an adhesive film 22 is formed on the inner surface and the outer surface of the hollow tube 20. The process of forming the adhesive film 22 on the inner surface and the outer surface of the hollow tube 20 has been described previously in the first embodiment so will not be reiterated.

In conclusion, the wood-made straw of present invention is made of natural material. It costs 1-6 months to naturally decompose the wood-made straw. The wood-made straw has short biodegradable time and a value for environment protection. Due to the adhesive film, the wood-made straw of the present invention has the flexible, soft, and moistureproof features. On top of that, the present invention has the fabrication cost, the simple structure, conveniently-processed and rapidly-processed properties, and the high production efficiency.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. A wood-made straw comprising:

a hollow tube comprising a wood layer; and an adhesive film wrapping an outer surface and an inner surface of the hollow tube;

wherein the wood layer is a basswood sheet, a birch sheet, a maple sheet, a cedarwood sheet, an ash sheet, a rubber wood sheet, a *paulownia* log sheet, a beech sheet, a cypress sheet, a poplar sheet, a *cunninghamia lanceolata* sheet, a camphorwood sheet, or a pine sheet;

wherein the wood layer has a density of larger than 0.42 g/cm$^3$;

wherein the wood layer further comprises two raw wood layers and a paper layer therebetween.

2. The wood-made straw according to claim 1, wherein the raw wood layers are basswood sheets, birch sheets, maple sheets, cedarwood sheets, ash sheets, rubber wood sheets, *paulownia* log sheets, beech sheets, cypress sheets, poplar sheets, *cunninghamia lanceolata* sheets, camphorwood sheets, or pine sheets.

3. The wood-made straw according to claim 1, wherein each of the raw wood layers has a density of larger than 0.42 g/cm$^3$.

4. The wood-made straw according to claim 1, wherein the paper layer is glassine paper, simili paper, or laminating paper.

5. The wood-made straw according to claim 1, wherein a first glue is formed between the paper layer and each of the raw wood layers to combine the raw wood layers with the paper layer.

6. The wood-made straw according to claim 5, wherein the first glue and the adhesive film comprise an edible glue.

7. The wood-made straw according to claim 5, wherein a second glue is formed on the wood layer, and the wood layer uses the second glue to stick to each other and form the hollow tube after winding the wood layer.

8. The wood-made straw according to claim 7, wherein the second glue comprises an edible glue.

* * * * *